United States Patent [19]

Lin

[11] Patent Number: 4,940,152

[45] Date of Patent: Jul. 10, 1990

[54] NURSING BOTTLE

[76] Inventor: Tzong-Shyan Lin, No. 1, Lane 144, Min Sheng Road, Sec. 2, Tainan, Taiwan

[21] Appl. No.: 371,818

[22] Filed: Jun. 27, 1989

[51] Int. Cl.[5] ..... A61J 9/00; A61J 9/04

[52] U.S. Cl. ..... 215/11.5; 215/11.1; 222/464

[58] Field of Search ..... 215/11.1–11.6, 215/1 A; 222/464

[56] References Cited

U.S. PATENT DOCUMENTS

| | | | |
|---|---|---|---|
| 2,655,279 | 10/1953 | Wolf | 215/11.1 X |
| 2,742,168 | 4/1956 | Panetti | 215/11.4 |
| 2,744,529 | 5/1956 | Tichy | 215/11.4 |
| 2,868,203 | 1/1959 | Tichy | 215/11.1 X |
| 3,044,650 | 7/1962 | Oltion et al. | 215/11.1 |
| 3,059,797 | 10/1962 | Wilkinson et al. | 215/11.1 |
| 3,346,133 | 10/1967 | Herdman | 215/11.1 |
| 3,411,648 | 11/1968 | Tichy | 215/11.4 |
| 3,441,160 | 4/1969 | Levy | 215/11.1 |
| 3,547,296 | 12/1970 | Greenberg | 215/11.4 |
| 3,704,803 | 12/1972 | Ponder | 215/11.4 X |

FOREIGN PATENT DOCUMENTS

| | | | |
|---|---|---|---|
| 208564 | 3/1909 | Fed. Rep. of Germany | 215/11.1 |
| 2067416 | 7/1981 | United Kingdom | 215/11.4 |

*Primary Examiner*—Sue A. Weaver

*Attorney, Agent, or Firm*—Burns, Doane, Swecker & Mathis

[57] ABSTRACT

This invention is an easy-suck nursing bottle and a fixing disc mounted between the bottle mouth and a nipple secured on the above by a cover skirt for attachment of special suction means. A flexible internal suction pipe communicating with the nipple is provided at the bottom end thereof with a weight and a float permitting the bottom end of the pipe to float on the liquid surface by the float and also the opening at the bottom end of the pipe to be maintained constantly at slightly below the liqiud surface so that liquid can always be sucked from around the surface of the liquid in the bottle.

4 Claims, 1 Drawing Sheet

FIG. 1
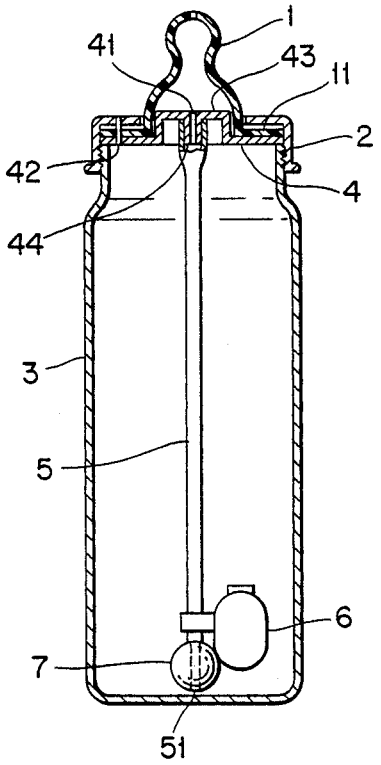
FIG. 2a
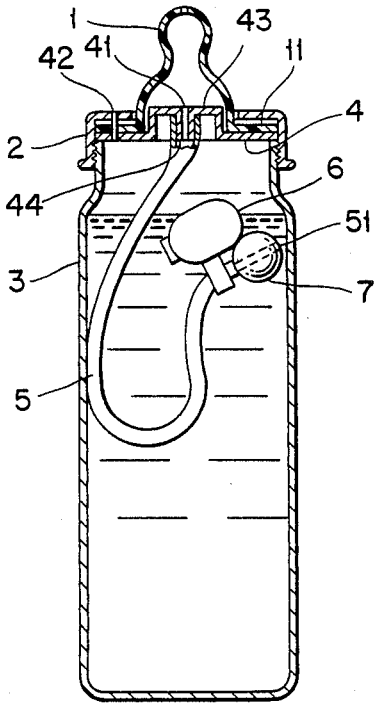
FIG. 2b
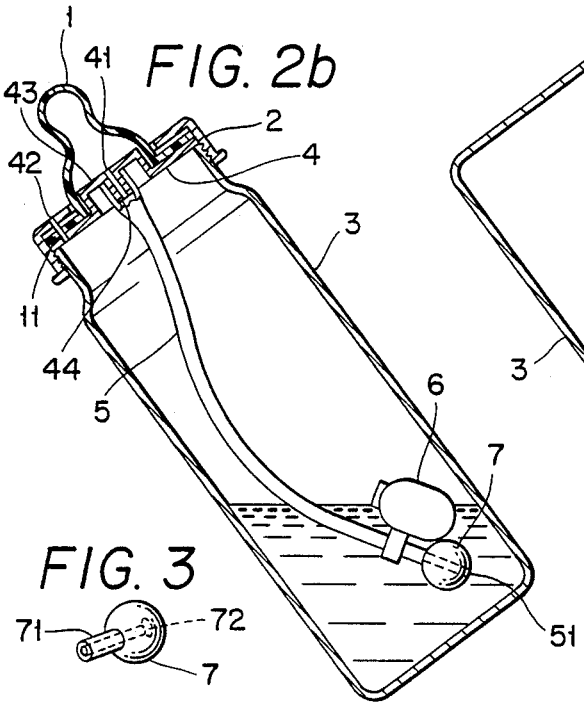
FIG. 2c
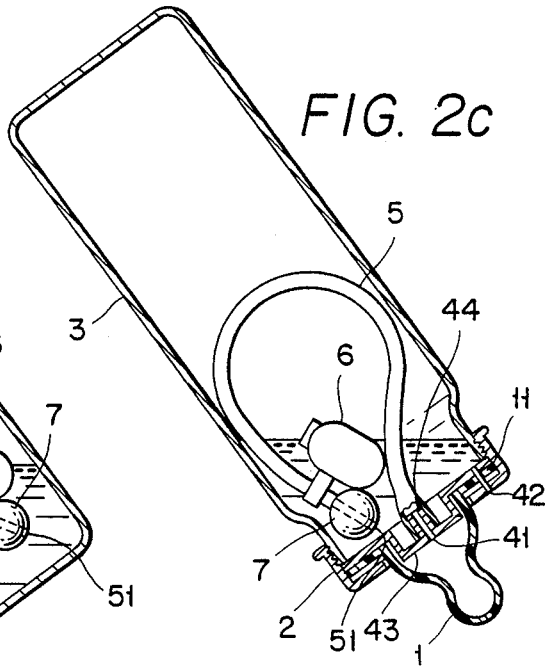
FIG. 3

NURSING BOTTLE

BACKGROUND AND SUMMARY OF THE INVENTION

The present invention relates to an easy-suck nursing bottle and, more particularly, to a nursing bottle having suction means where liquid can always be sucked from around the surface of the liquid through a suction pipe in the bottle at any angle of inclination of the bottle.

In a conventional nursing bottle, when the level of liquid falls down in the bottle the user has always to change the angle with which he/she grips the bottle so that bottom of the bottle will face upward and the nipple on the bottle mouth will face downward in order to suck the liquid. This frequent change in the gripping angle is a cumbersome action and is rather inconvenient. If, in a simple way, a suction pipe of hard material is inserted inside the nursing bottle, it will however require that during use the bottle be always held with the bottom facing downward in order to suck the content; otherwise, if bottom of the bottle faces upward, the opening at the terminal end of the suction pipe will always be exposed out on the surface of the liquid making it impossible to suck. Such a drawback also causes difficulty and inconvenience for babies to use and is indeed in need for an improvement.

An object of the present invention is to solve the above noted drawbacks and to provide a novel, easy-suck nursing bottle, including therein principally: a flexible internal suction pipe communicating with the nipple, a float and a weight element having a weight less than the buoyancy force of the float being provided at the bottom end of the suction pipe thereby permitting the bottom end of the suction pipe to float on the liquid surface by the float and also permitting the opening at the bottom end of the suction pipe to be maintained always at slightly below the liquid surface so that liquid can always be sucked from the liquid surface.

A further object of the present invention is to provide an easy-suck nursing bottle having a fixing disc mounted between the bottle mouth and the nipple being secured on the above by a cover skirt, the fixing disc including in the middle an upwardly protruding member and a side air hole, this upwardly protruding member formed in turn in the center thereof with a passage hole and on the bottom central part with a section of downwardly projecting connector communicating with the passage hole whereby to join with the suction pipe.

A still further object of the present invention is to provide an easy-suck nursing bottle having a section of protruding pipe connector integrally formed in the passage hole of the weight element to facilitate direct insertion thereto of the bottom end of the suction pipe for convenient assembly.

Other objects and advantages of the invention will become apparent from the following description of a preferred embodiment of the invention, as illustrated in the accompanying drawings.

BRIEF DESCRIPTION OF THE DRAWINGS

In the drawings:

FIG. 1 is a longitudinal sectional view of an easy-suck nursing bottle of the invention;

FIGS. 2*a*, 2*b* and 2*c* are illustrations showing nursing bottle of the present invention under three conditions of use; and FIG. 3 is a perspective view of the weight element of the nursing bottle.

DETAILED DESCRIPTION OF THE PREFERRED EMBODIMENT

Referring initially to FIGS. 1 and 2, the easy-suck nursing bottle of the present invention comprises a bottle 3 including a nipple 1 and a cover skirt 2 retaining the nipple 1 onto the bottle mouth where, between the bottle mouth and the bottom surface of the circumferential flange 11 of the nipple 1 is mounted a fixing disc 4 having a passage hole 41 formed in the center and an air hole 42 on one side thereof. The air hole 42 communicates the inside of the bottle 3 with the atmosphere to equalize the pressure inside the bottle 3 as liquid is sucked out of the bottle 3. This fixing disc 4 is in turn formed in the center with an upwardly protruding member 43 which fits inside the nipple 1 to support the nipple 1, and in the center projecting downwardly from the bottom side of the upwardly protruding member 43 is located a pipe connector 44 communicating with the passage hole 41. A flexible suction pipe 5 has one end fitted over the pipe connector 44 and the other end hanging into the bottom of the bottle 3. Disposed at the terminal end 51 or the lower end of the suction pipe 5 is a float 6 capable of floating the terminal end 51 of the pipe on the liquid surface while a stainless steel weight element 7 having a weight less than the buoyancy force of the float 6 is next fitted by a middle passage hole over the terminal end of the flexible pipe. The weight element 7 has, as shown in FIG. 3, a section of outwardly projecting, vertically through plastic pipe connector 71 formed integrally inside the passage hole thereof and a side suction hole 72 so as to facilitate insertion of the weight element in the terminal end 51 of the suction pipe 5 and to maintain the suction opening behind the terminal end 51 of the suction pipe to be always placed slightly below the liquid surface at the bottom side of the float.

When the easy-suck nursing bottle of the present invention is filled with a liquid, such as milk, as shown in FIG. 2*a*, the opening 72 behind the terminal end of the suction pipe 5 will float around on the liquid surface by the float 6. Owing to the fact that the suction pipe 5 is resilient and flexible and which does not interfere with the curving action of the pipe 5, and also that the terminal end 51 of the pipe 5 is always held slightly underneath the liquid surface, that is, the opening 72 of weight element 7 behind the terminal end 51 thereof is held slightly below the liquid surface, during use liquid can be sucked from around the surface of the liquid in the bottle. Next, when the nursing bottle 3 is gripped in the inclination position for ready use, as illustrated in FIG. 2*b*, the opening 52 behind the terminal end of the suction pipe 5 will still be around on the liquid surface thereby facilitating sucking of the liquid. Again, when the nursing bottle 3 is held to an inverted position as shown in FIG. 2*c*, its suction pipe 5 will still resiliently curve and by means of the float 6 and weight element 7 it will still hold the opening 72 of the suction pipe 5 well around the liquid surface to facilitate sucking of the liquid. The unique arrangement will make it unnecessary for concern with the angle of gripping of the nursing bottle 3 and will thus make easy its use by the babies.

It may also be appreciated that the nursing bottle 3 is without a float 6 near the weight element 7 at the terminal end of the suction pipe 5. In this arrangement, the opening at the back of the terminal end of the suction pipe 5 will always be held towards the bottom of the liquid inside the bottle due to the weight element 7 and the baby will be able to suck the liquid with similar ease.

I claim:

1. A nursing bottle, comprising:

a fixing disk mounted on the nursing bottle and including a first pipe connector projecting downwardly from the center of said fixing disk, said fixing disk functioning to cap said nursing bottle;

a nipple mounted on said fixing disk;

suction means for defining a suction opening and including a length of flexible suction pipe connected at one end to said first pipe connector, and a weight element connected to the other end of said flexible suction pipe; and a float attached to said suction means adjacent said weight element, said float having a buoyancy force greater than the weight of said weight element to keep said suction opening submerged near the surface of a liquid in said nursing bottle.

2. A nursing bottle as claimed in claim 1, wherein aid fixing disk includes an upwardly protruding member formed in the center of said fixing disk, said upwardly protruding member fitting inside said nipple to support said nipple; said first pipe connector extending downwardly from said upwardly protruding member.

3. A nursing bottle as claimed in claim 1, further comprising:

an air hole formed through one side of said fixing disk, said air hole communicating the inside of said nursing bottle with the atmosphere to equalize the pressure inside said nursing bottle as the liquid is sucked out of said bottle.

4. A nursing bottle as claimed in claim 1, wherein said weight element includes said suction opening and an outwardly projecting second pipe connector, said second pipe connector connecting said suction opening to said flexible suction pipe.

* * * * *